US005964652A

United States Patent [19]

Melzner et al.

[11] Patent Number: 5,964,652

[45] Date of Patent: Oct. 12, 1999

[54] APPARATUS FOR THE CHEMICAL-MECHANICAL POLISHING OF WAFERS

[75] Inventors: Hanno Melzner, Dresden; Hermann Wendt, Grasbrunn, both of Germany

[73] Assignee: Siemens Aktiengesellschaft, Munich, Germany

[21] Appl. No.: 08/911,410

[22] Filed: Aug. 14, 1997

[30] Foreign Application Priority Data

Aug. 14, 1996 [DE] Germany ..... 196 32 809

[51] Int. Cl.[6] ..... B24B 5/00; B24B 29/00

[52] U.S. Cl. ..... 451/285; 451/254; 451/258

[58] Field of Search ..... 451/41, 28, 42, 451/44, 182, 183, 231, 254, 258, 446, 285, 286, 287, 288, 289, 177, 178, 172, 173

[56] References Cited

U.S. PATENT DOCUMENTS

| | | | |
|---|---|---|---|
| 3,120,724 | 2/1964 | Mockiewicz et al. . | |
| 3,252,775 | 5/1966 | Tocci-Guilbert . | |
| 3,919,811 | 11/1975 | Hedelin | 451/42 |
| 3,922,821 | 12/1975 | Canterbury | 451/42 |
| 4,268,999 | 5/1981 | Noto et al. . | |
| 5,083,401 | 1/1992 | Yamashita et al. . | |
| 5,564,966 | 10/1996 | Nishioka et al. | 451/178 |
| 5,643,056 | 7/1997 | Hirose et al. | 451/41 |
| 5,688,360 | 11/1997 | Jairath | 451/41 |
| 5,700,179 | 12/1997 | Hasegawa et al. | 451/41 |
| 5,707,274 | 1/1998 | Kim et al. | 451/41 |
| 5,725,414 | 3/1998 | Moinpour et al. | 451/41 |
| 5,735,731 | 4/1998 | Lee | 451/388 |

FOREIGN PATENT DOCUMENTS

| | | |
|---|---|---|
| 0 724 932 A1 | 8/1996 | European Pat. Off. . |
| 195 40 626 A1 | 6/1996 | Germany . |

OTHER PUBLICATIONS

"Wafer bonding", W. P. Maszara, Microelectronic Engineering, vol. 22, 1993, pp. 301–302.

Japanese Patent Abstract No. 4–263425 (Udou), dated Sep. 18, 1992.

Japanese Patent Abstract No. 55–58984, dated May 2, 1980.

*Primary Examiner*—David A. Scherbel
*Assistant Examiner*—Darris Holt Banks
*Attorney, Agent, or Firm*—Herbert L. Lerner; Laurence A. Greenberg

[57] ABSTRACT

An apparatus for the chemical-mechanical polishing of wafers has a rotating disk provided with a polishing body, a supply device for a polishing fluid and a holding device for the wafer. An axis of the disk runs parallel to the surface of the wafer. A cylindrical edge surface of the disk is provided with the polishing body in such a way that a trench with a specific cross section can be made in the wafer.

9 Claims, 3 Drawing Sheets

APPARATUS FOR THE CHEMICAL-MECHANICAL POLISHING OF WAFERS

BACKGROUND OF THE INVENTION

Field of the Invention

The present invention relates to an apparatus for the chemical-mechanical polishing of wafers, having a rotating disk provided with a polishing body, a supply device for a polishing fluid and a holding device for the wafer.

Chemical-mechanical polishing (CMP) was employed for the first time on a relatively large scale in the production of 16-megabit DRAMs and has since proved to be a method of ever-increasing importance. Thus, for example, it is employed for the production of trenches, trench insulations and metal tracks as well as for the planarization of intermetallic dielectrics (IMD). One example of trench insulation is so-called shallow trench insulation (STI). It was shown that, in all of the above-mentioned fields of use of chemical-mechanical polishing, problems arise in so far as sharp fluctuations in the removal of material frequently occur over a wafer and from wafer to wafer.

There are also similar problems in the production of SOI wafers (SOI=silicon on insulator) through the use of the wafer bonding method. In that method, two wafers, which are composed of silicon and which each have a silicon dioxide layer on their surface, are "bonded" to one another through those silicon dioxide layers, so as to result, as a whole, in a semiconductor body which has an oxide layer in the middle that is composed of the two silicon dioxide layers. One of the wafers is then ground down, in order to finally obtain a thin silicon layer on the oxide layer. That grinding process is not sufficiently uniform per se in order to ensure a sufficiently small fluctuation in the thickness of the thin silicon layer.

The so-called PACE (Plasma-Assisted Chemical Etching) method has recently been employed in order to increase the uniformity of the grinding process (see "Microelectronic Engineering", Volume 22, page 301, 1993). In that method, first the wafer thickness remaining after a first coarse grinding step is measured in profile over the wafer. A relatively small plasma etcher, which has a diameter of between 3 and 30 mm and which is controlled by a computer through the use of measured layer thickness data, is then led over the wafer, so that the desired ultimate layer thickness can be achieved everywhere on the wafer. Thickness fluctuations which are below 10 nm can be achieved through the use of that procedure.

In conventional CMP, a rotating disk-shaped polishing body having a polishing cloth or "pad" is used, in order to polish a wafer which is placed in the region of a radius of the polishing body in the same plane as the surface of the latter.

$\mu$-chemical-mechanical polishing ($\mu$CMP) also uses the above-mentioned computer-controlled principle: after a first conventional CMP step, in which most of the material to be taken off is removed rapidly, the remaining layer thickness is measured over the wafer. For that purpose, special measuring zones are provided in each chip on the wafer, which are traversed by an automatic measuring instrument. If it is possible to measure all locations over the wafer, then specific predetermined points can also simply be selected. In that case, the measuring zones or the predetermined points must be placed so closely to one another that the layer thickness between the measuring zones or points is defined essentially by interpolation between the measuring zones or points. The wafer is then traversed by a special $\mu$CMP polishing apparatus which only ever touches a relatively small region of the wafer momentarily.

In that case, at least three parameters are appropriate for varying the amount of material removed by polishing in conformity with the measurement data for the layer thickness: the rotational speed of the polishing body, the contact pressure of the polishing body on the wafer and the traveling speed of the polishing body relative to the surface of the wafer.

With regard to a round wafer, it is possible, for example, to use a spiral path of the polishing body. In that case, the polishing body is applied in the middle of the wafer and is then led spirally as far as the edge of the wafer, with the paths in each case overlapping one another to a greater or lesser extent. A spiral path of that type can be executed particularly easily. The holding device for the wafer or the wafer chuck rotates slowly, while the polishing body is led outward from the mid-point of the wafer in a linear movement. Alternatively, it is also conceivable to traverse the wafer in linear strips. It is also possible to employ a plurality of polishing bodies simultaneously on a wafer, in order to thereby shorten the machining time. In that case, the rotational speed and/or contact pressure and/or traveling speed may be set individually for each polishing body. At the same time, change in the rotational speed could possibly be advantageous for varying the removal of material.

Previous $\mu$CMP apparatuses use polishing bodies, the axes of which run perpendicularly to the wafer surface in the same way as in the CMP apparatuses that have been known for some time. In other words, all of the previous apparatuses for the chemical-mechanical polishing of wafers have polishing bodies, the axis of rotation of which is led perpendicularly to the wafer surface. It is not beneficial to use the previous configuration, having an axis of rotation of the polishing body perpendicular to the wafer surface, and to merely employ a smaller polishing body, in order to grind a small part of the wafer surface.

That is because, during a polishing process, the surface of a polishing cloth or pad of the polishing body, which cloth or pad is composed of PU foam (PU=polyurethane) or a textile material, is not exposed so as to be sprinkled with a polishing fluid or "slurry".

For the same reason, it is difficult, during polishing, to treat the polishing cloth specially through the use of a grinding body for roughening purposes, since that is likewise possible only when the surface of the polishing cloth is accessible. So-called "pad conditioning" is therefore difficult to carry out.

Finally, a W-shaped material removal profile is obtained when a rotating grinding disk, with an axis perpendicular to the wafer surface, is drawn over the surface of the wafer, with the profile having steep flanks or lateral edges. The W-shape is attributable to the fact that the period of action between the polishing cloth and the wafer is short at the edge of the disk, while in the middle of the disk, the theoretical rotational speed "0" prevails. Such a W-shaped material removal profile is somewhat unsuitable for achieving uniform material removal. If, for example, two trenches having a W-shaped material removal profile of that type run parallel to one another, the steep flanks or lateral edges will cause any error in the relative position of the trenches to one another to result in sharp fluctuations in the removal of material in the overlap region.

SUMMARY OF THE INVENTION

It is accordingly an object of the invention to provide an apparatus for the chemical-mechanical polishing of wafers, which overcomes the hereinafore-mentioned disadvantages of the heretofore-known devices of this general type, in which a surface of a polishing cloth is accessible during a material removal process and which allows a uniform removal of material over a surface of a wafer.

With the foregoing and other objects in view there is provided, in accordance with the invention, an apparatus for the chemical-mechanical polishing of wafers, comprising a holding device for a wafer having a surface; a rotating disk having an axis running parallel to the surface of the wafer and having a cylindrical edge surface; a polishing body applied to the cylindrical edge surface of the disk for producing a trench with a specific cross section in the wafer; and a device for supplying a polishing fluid to the polishing body.

Therefore, in the apparatus according to the invention, the axis of the polishing body runs parallel to the surface of the wafer. In this case, the polishing body is applied to the edge or the "outer cylindrical surface" of the disk, so that the polishing body touches the surface of the wafer at a point on the circumference of the disk. Furthermore, a movement device is provided, so that the axis of the polishing body and the wafer can be moved at least in a direction parallel to the surface of the wafer. In this case, the feed between the disk and the wafer may be set, for example, perpendicularly to the axis of the polishing body.

Such a structure of the apparatus affords, in particular, the following advantages:

During a polishing process, the polishing cloth is open or exposed, with the exception of a point of contact with the surface of the wafer, and can be wetted and treated continuously with polishing fluid.

The profile of the material removal trench can be set within wide limits, and, for example, material removal trenches having a triangular profile or a trapezoidal profile can readily be achieved. This will be explained further below in more detail.

In the apparatus of the present invention, the movement of the polishing cloth relative to the wafer always takes place in one direction. In conventional apparatuses, the wafer rotates, so that on average, all directions occur with approximately the same frequency. Nevertheless, in the apparatus according to the invention, the movement between the polishing cloth and the wafer in only one direction is not critical, since the main part of a layer to be removed can be removed before in the conventional way. It is also possible for the wafer to be machined several times in different orientations.

Moreover, the fixed grinding direction offers some advantage with regard to the automatic detection of scratches which are induced by the chemical-mechanical polishing and which occur repeatedly as a result of contaminations of the polishing cloth. This is because since these scratches run in a specific direction, they can easily be attributed automatically to the corresponding process.

In addition to the accurate controllability of the removal of material, the apparatus according to the invention also has the advantage of a highly compact structure: as opposed to conventional apparatuses with a standing area of several square meters, the size of the apparatus according to the invention is comparable to that of a shortened bench lathe.

In accordance with another feature of the invention, there is provided a wafer chucking device serving as a holding device, which can be mounted resiliently on a bearing device that is composed of a transverse support and a longitudinal support.

The basic structure of the apparatus according to the invention can therefore be compared with that of a lathe having a horizontal spindle, a transverse support and a longitudinal support. The transverse support and the longitudinal support each have a motor drive. Moreover, electronic rotational speed control is provided for the disk.

In light of the relatively simple structure and the smaller standing area required, it is even conceivable to dispense completely with a first machining step in conventional polishing and, instead, to use the apparatus according to the invention twice for the removal of material in the case of the same disk. In a first step the rotational speed is controlled relatively approximately and, in a second step, the rotational speed is then set with fine control.

The polishing cloth can be changed in a simple way by exchanging the disk. The disks can then be covered with new polishing cloths, without the throughput of the apparatus being reduced.

In accordance with a further feature of the invention, the polishing fluid supply device can supply the polishing body constantly with polishing fluid.

In accordance with an added feature of the invention, in order to produce a trench of triangular cross section, a polishing body composed of two polishing body parts, each with a parallelogram-shaped contour, in which the perpendicular to one narrow side intersects an opposite corner point, can be applied to the edge surface of the disk. Such a material removal trench of triangular profile is particularly desirable, since, when two such material removal trenches overlap, a theoretically perfectly uniform removal of the material is achieved when the distance between the two trenches is half a trench width. This triangular profile is obtained since the removal of material is, in close approximation, proportional to the time during which a specific point on the polishing body is in contact with the wafer.

In accordance with an additional feature of the invention, in order to produce a trench of trapezoidal cross section, a polishing body composed of two polishing body parts, each with a parallelogram-shaped contour, in which the perpendicular to one narrow side intersects the opposite narrow side, can be applied to the edge surface of the disk.

Profiles which are more complicated than triangular or trapezoidal profiles can, of course, also be achieved.

In accordance with yet another feature of the invention, the diameter of the disk is about 10 cm and the edge width of the disk, that is to say the height of the "cylinder", measures about 1 cm.

In accordance with a concomitant feature of the invention, as in conventional apparatuses, the polishing body may be produced from polyurethane foam or textile material.

Other features which are considered as characteristic for the invention are set forth in the appended claims.

Although the invention is illustrated and described herein as embodied in an apparatus for the chemical-mechanical polishing of wafers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
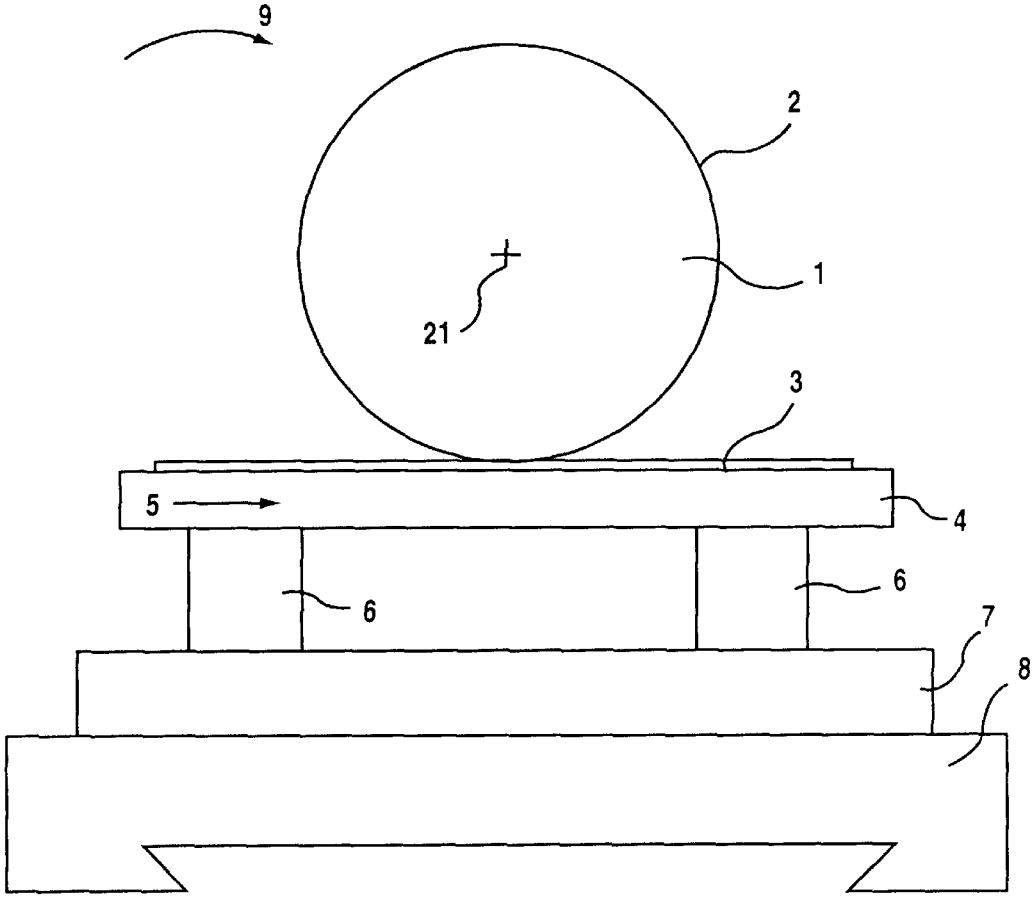
FIG. 1 is a diagrammatic, side-elevational view of an apparatus according to the invention.

Referring now to the figures of the drawings in detail and first, particularly, to FIG. 1 thereof, there is seen a grinding or polishing disk 1 having an edge to which a polishing cloth 2 is applied as a polishing body. This polishing cloth 2 may be formed of polyurethane foam or of textile material. A wafer 3 is treated through the use of the polishing cloth 2 in order to produce a material removal trench in the wafer. The wafer 3 is fastened by a holding device on a table, as is indicated by reference numeral 4. The table is subjected to a feed in the direction of an arrow 5. The table has a device 6 for parallel guidance with springiness and height adjustment. The table having the device 6 is mounted on a transverse support 7 and a longitudinal support 8. Elements 6, 7 and 8 form a bearing device for the holding device, which may be a wafer chucking device. An axis 21 of the disk 1 runs parallel to the surface of the wafer 3 and not, as was customary heretofore, perpendicular thereto.

During the machining of the surface of the wafer 3, the polishing cloth 2 must be sprinkled with polishing fluid and treated or roughened. As is immediately evident from FIG. 1, the surface of the polishing cloth 2 is freely accessible, with the exception of a point of contact with the surface of the wafer 3, so that the polishing fluid can be readily supplied and the polishing cloth can also be readily treated or roughened. A supply device for the polishing fluid is indicated diagrammatically by an arrow 9.

Figure 2:
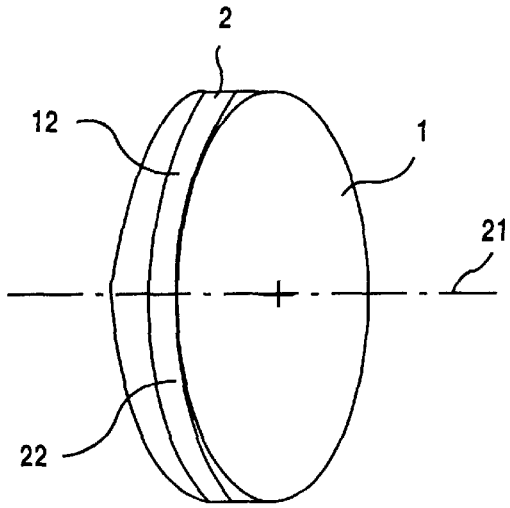
FIG. 2 is a perspective view of a disk having a polishing body applied thereon, for achieving a material removal trench with a triangular profile.

FIG. 2 shows a perspective illustration of the disk 1 having an edge or outer cylindrical surface on which the polishing body is applied or coated in the form of the polishing cloth 2. The disk 1 has a diameter of about 10 cm and a height or width of about 1 cm.

The disk shown in FIG. 2 is suitable for producing a material removal trench having a triangular profile. This is explained in more detail with reference to FIG. 3.

Figure 3:
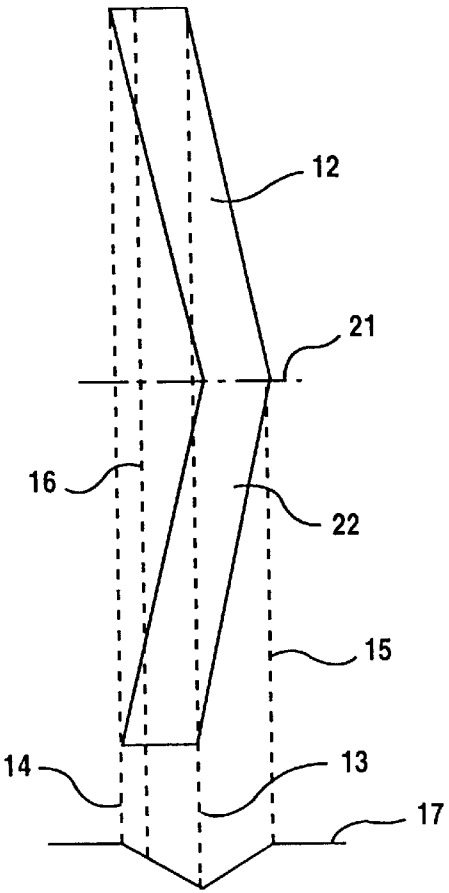
FIG. 3 is a developed view of a polishing body for achieving a material removal trench with a triangular profile.

As was already explained initially, the removal of material is, in close approximation, proportional to the time during which a specific point on the material removal cloth 2 is in contact with the surface of the wafer 3. FIG. 3 therefore shows a top view of two parallelogram-shaped material removal cloths 12 and 22, before they are applied to the edge of the disk 1, as is illustrated in FIG. 2. A broken line 13 in each case runs through two opposite corner points of the two parallelograms and therefore completely within both parallelograms. That is to say, in the region of this broken line, the polishing cloths are constantly in contact with the surface of the wafer, in conformity with the parallelograms 12 and 22. In other words, the greatest removal of material is achieved at this location. In a region of broken lines 14 and 15, only punctiform contact occurs between the polishing cloth 2 and the surface of the wafer 3. Therefore, in that location the removal of material is minimal. A broken line 16 stands for a relatively slight removal of material, since it runs only a short distance through the parallelograms 12 and 22.

Altogether, therefore, a material removal trench with a triangular profile 17 is obtained through the use of a polishing body constructed according to the exemplary embodiment of FIG. 3.

Figure 4:
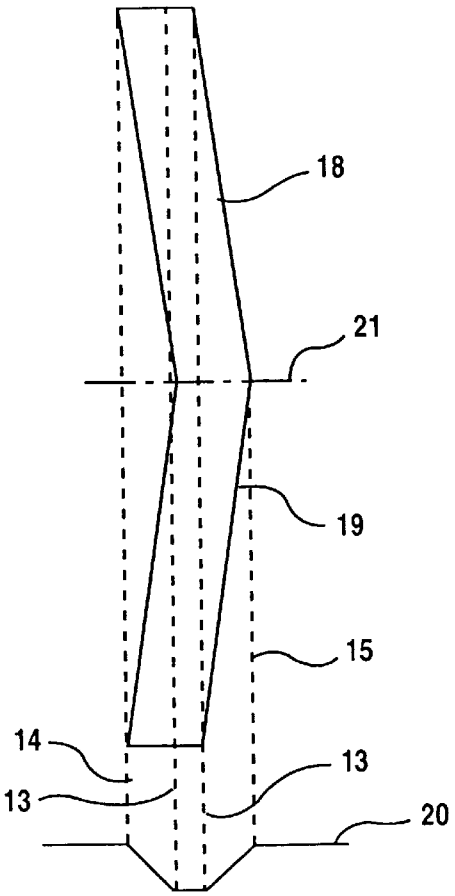
FIG. 4 is a developed view of a polishing body for achieving a material removal trench with a trapezoidal profile.

FIG. 4 provides an example of a covering of the edge of the disk 1 with a polishing cloth 2 which is constructed from two parallelogram-shaped parts 18, 19, in such a way that a profile 20 with a trapezoidal cross section is achieved. Two broken lines 13 indicate an edge of the region with maximum removal of material, while the broken lines 14, 15 denote the commencement of the removal of material by punctiform contact between the polishing body and the wafer 3.

Figure 5:
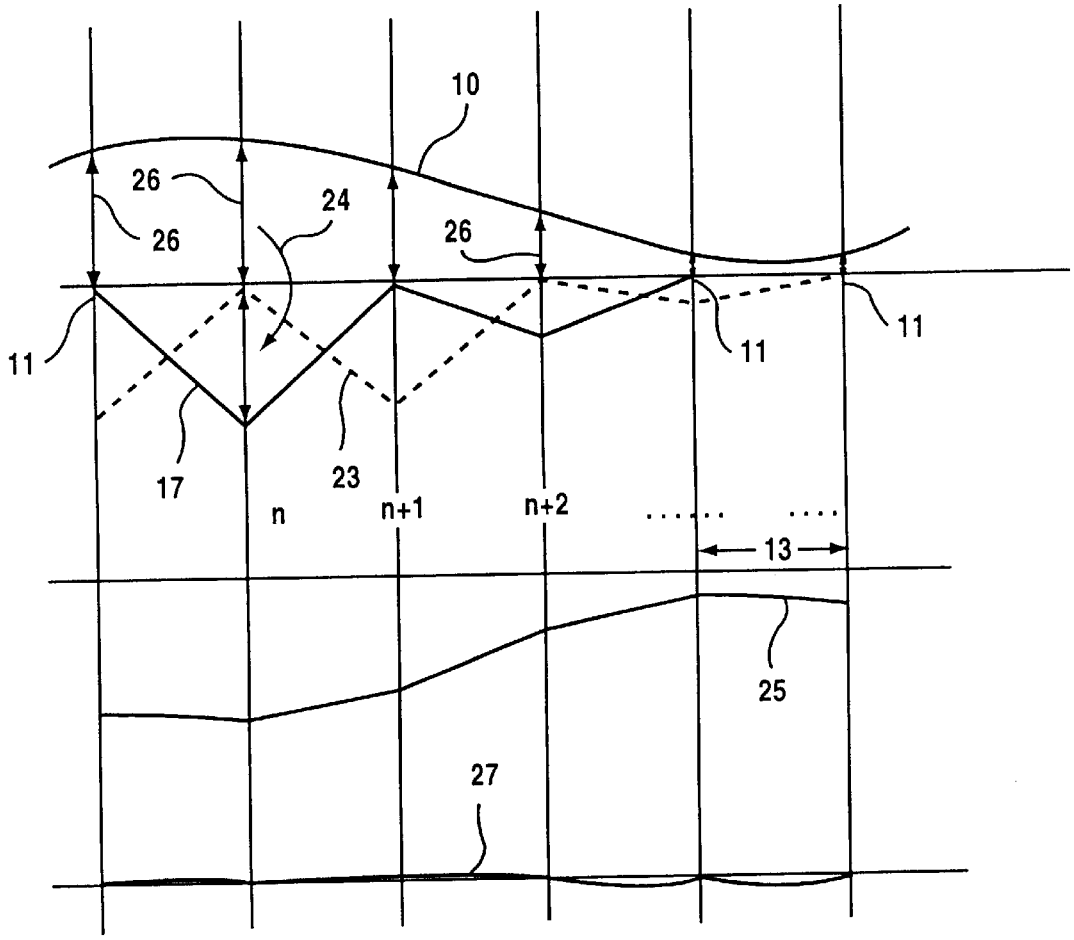
FIG. 5 is a graph used to explain an equalization of existing thickness fluctuations by a data-controlled removal of material.

FIG. 5 illustrates an equalization of existing and measured thickness fluctuations through the use of the apparatus according to the invention. A thickness profile 10 which has been discovered can be equalized when a thickness between two measurement points 11 at a distance of half a trench width 13 is defined essentially by linear interpolation between these measurement points and thickness measurements are available at the measurement points. In FIG. 5, removals of material are illustrated by an unbroken curve 17 for trenches n, n+2, . . . and by a broken curve 23 for trenches n+1, n+3, . . . . In this case, the size of the removal of material in the middle of the trench is controlled by respective measured values 26 at the measurement points 11, as is indicated by an arrow 24. A total amount of material removed is obtained from a sum of the removals according to the curves 17 and 23 and is indicated by a curve 25. When this total amount of material which is removed (curve 25) is subtracted from the thickness profile 10 that is discovered, a final profile 27 having a virtually planar surface is obtained.

We claim:

1. An apparatus for the chemical-mechanical polishing of wafers, comprising:

a holding device for a wafer having a surface;

a rotating disk having an axis running parallel to the surface of the wafer and having a cylindrical edge surface;

a polishing body applied to said cylindrical edge surface of said disk for producing a trench with a specific cross section in the wafer; and a device for supplying a polishing fluid to said polishing body.

2. The apparatus according to claim 1, including a bearing device, said holding device being a wafer chucking device mounted resiliently on said bearing device.

3. The apparatus according to claim 2, wherein said bearing device includes a transverse support and a longitudinal support.

4. The apparatus according to claim 1, wherein said polishing fluid supply device can supply said polishing body constantly with polishing fluid.

5. The apparatus according to claim 1, wherein said polishing body applied to said edge surface of said disk includes two polishing body parts each having a parallelogram-shaped contour with narrow sides and corner points, and a line perpendicular to one of the narrow sides intersects two of the corner points, for producing a trench with a triangular cross section.

6. The apparatus according to claim 1, wherein said polishing body applied to said edge surface of said disk includes two polishing body parts each having a parallelogram-shaped contour with opposite narrow sides, and a line perpendicular to one of the narrow sides intersects the opposite narrow side, for producing a trench with a trapezoidal cross section.

7. The apparatus according to claim 1, wherein said disk has a diameter of approximately 10 cm and said cylindrical edge surface has a width of approximately 1 cm.

8. The apparatus according to claim 1, wherein said polishing body is formed of polyurethane foam.

9. The apparatus according to claim 1, wherein said polishing body is formed of textile material.

* * * * *